US005840002A

United States Patent [19]

Happ

[11] Patent Number: 5,840,002

[45] Date of Patent: Nov. 24, 1998

[54] SUBSTANTIALLY RECTANGULAR-BOTTOMED CONTAINER, AND APPARATUS AND METHOD FOR MANUFACTURING SAME

[75] Inventor: Thomas W. Happ, Boswell, Ind.

[73] Assignee: Stone Container Corporation, Chicago, Ill.

[21] Appl. No.: 625,412

[22] Filed: Mar. 29, 1996

[51] Int. Cl.[6] ..... B31B 1/26; B26D 3/08

[52] U.S. Cl. ..... 493/399; 493/60; 493/241; 493/267; 493/355; 493/396; 83/882; 83/885; 83/698.41

[58] Field of Search ..... 493/58, 69, 60, 493/61, 62, 160, 240, 244, 355, 363, 364, 366, 370, 396, 399, 402, 403, 404, 63, 169, 241, 218, 68, 71, 72, 86, 162, 189, 194, 195, 196, 197, 198, 199, 64, 239, 356, 397, 398, 405; 83/882, 885, 51, 698.51, 698.41

[56] References Cited

U.S. PATENT DOCUMENTS

| | | | |
|---|---|---|---|
| 1,235,293 | 7/1917 | Daven . | |
| 1,746,284 | 2/1930 | Robinson | 493/403 |
| 2,475,868 | 7/1949 | Anderson | 493/403 |
| 2,949,827 | 8/1960 | Kempen | 493/403 |
| 3,717,074 | 2/1973 | Ramussen . | |
| 3,821,911 | 7/1974 | Seme | 83/11 |
| 4,132,157 | 1/1979 | Shinomiya | 493/403 |
| 4,417,883 | 11/1983 | Granger | 493/403 |
| 4,450,180 | 5/1984 | Watkins | 426/107 |
| 4,691,374 | 9/1987 | Watkins et al. | 383/104 |
| 4,846,778 | 7/1989 | Hirakawa | 493/354 |
| 4,856,400 | 8/1989 | Kelzer | 83/885 |
| 4,931,031 | 6/1990 | Lisiecki | 493/355 |
| 5,044,777 | 9/1991 | Watkins et al. | 383/100 |
| 5,474,383 | 12/1995 | Zuege et al. | 383/121 |

FOREIGN PATENT DOCUMENTS 81554 12/1956 Denmark .

*Primary Examiner*—Joseph J. Hail, III
*Assistant Examiner*—Christopher W. Day
*Attorney, Agent, or Firm*—Dick and Harris

[57] ABSTRACT

A container apparatus is deployable from a substantially flat, collapsed configuration to a substantially rectangular-bottomed configuration. The container apparatus includes a front panel, a back panel, a first gusseted side panel, and a second gusseted side panel. Each panel has a first transverse score line forming a peripheral edge of the substantially rectangular bottom upon the deployment of the container apparatus. This first transverse score line is scored in a first direction, extending substantially from the front panel towards the back panel of the container apparatus. Each panel further includes a second transverse score line substantially congruent with the first transverse score line. This second transverse score line is scored in a second direction, extending substantially from the back panel towards the front panel of the container apparatus. This congruence of the first and second transverse score lines serves to facilitate deployment of the container apparatus from its substantially flat, collapsed configuration to its substantially rectangular-bottomed configuration.

2 Claims, 2 Drawing Sheets

Fig 11
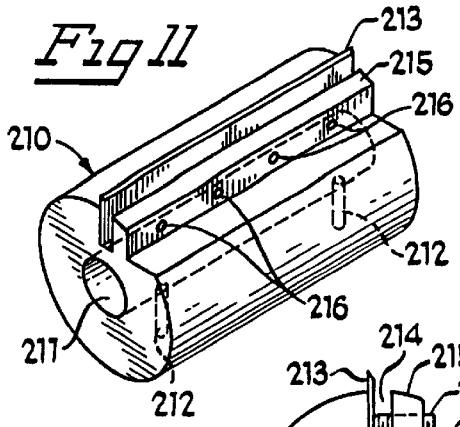
Fig 13
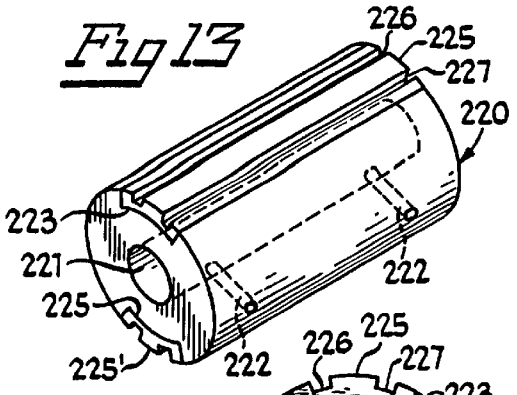
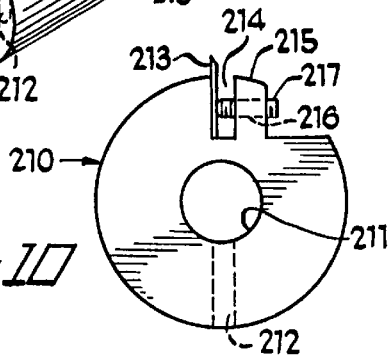
Fig 10
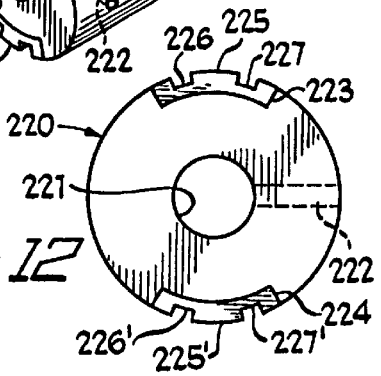
Fig 12
Fig 3
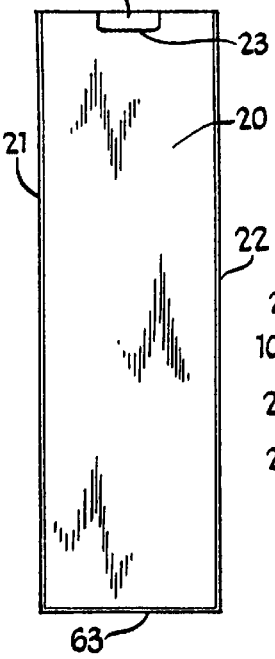
Fig 4
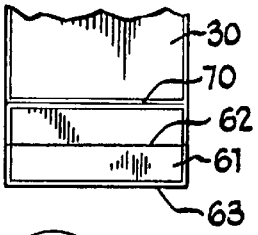
Fig 1
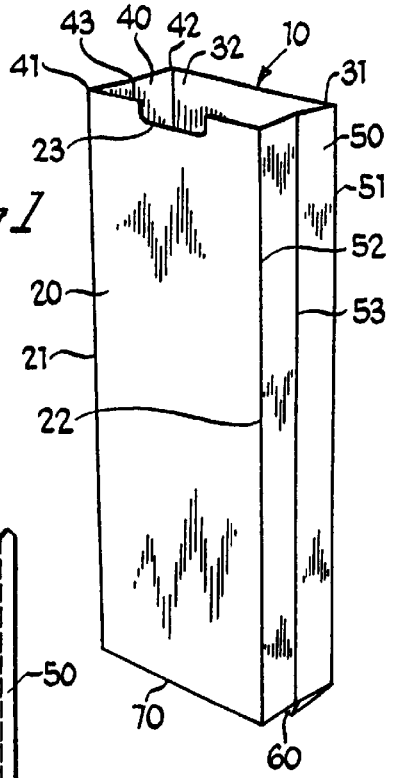
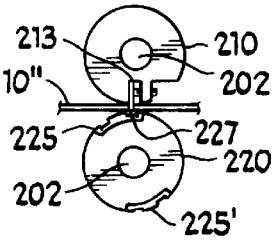
Fig 14
Fig 5
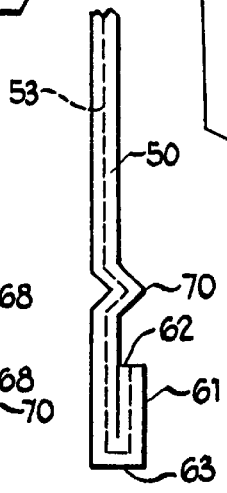
Fig 2
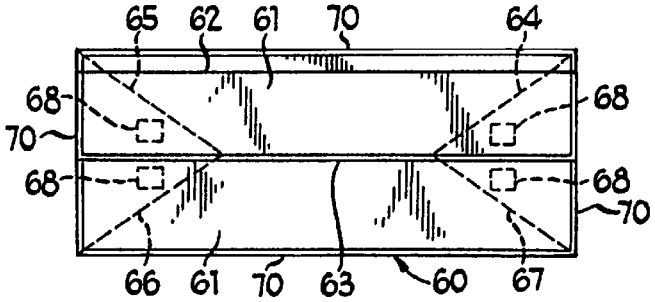

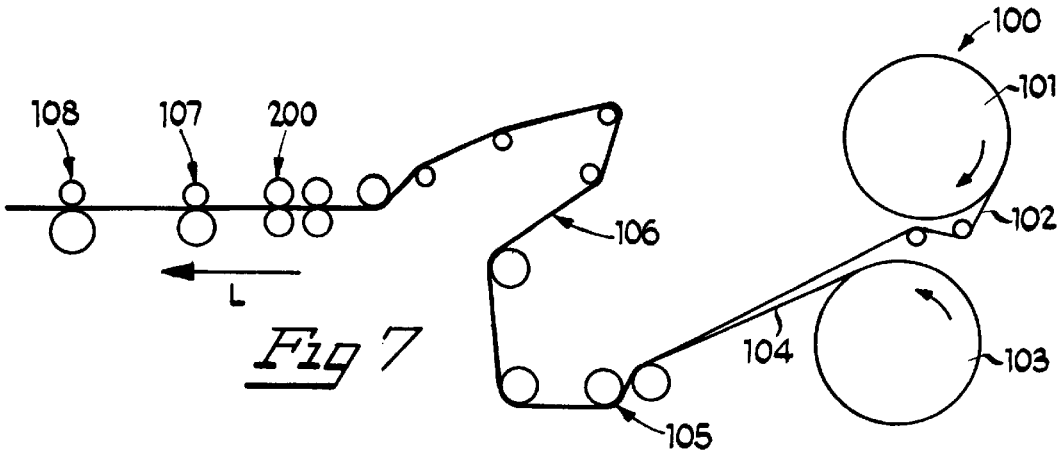
Fig 7
Fig 6
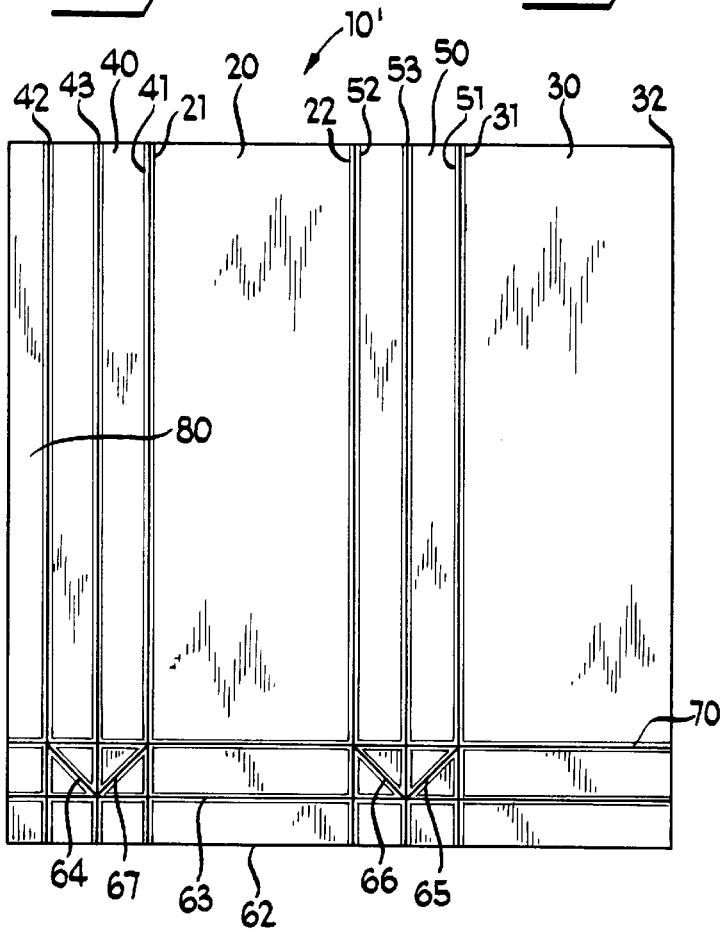
Fig 9
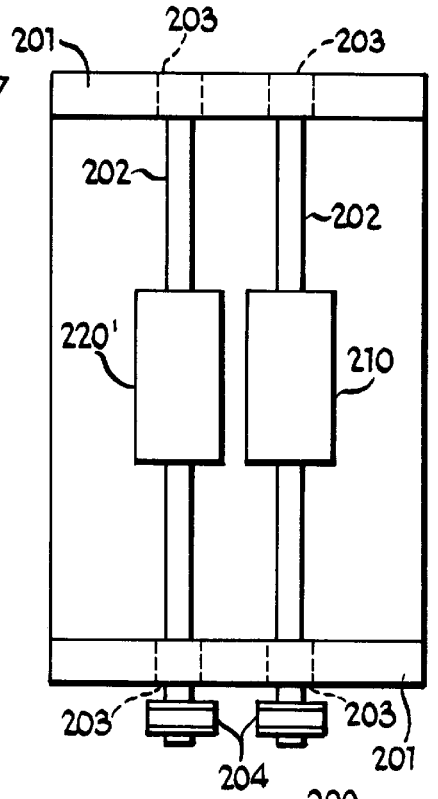
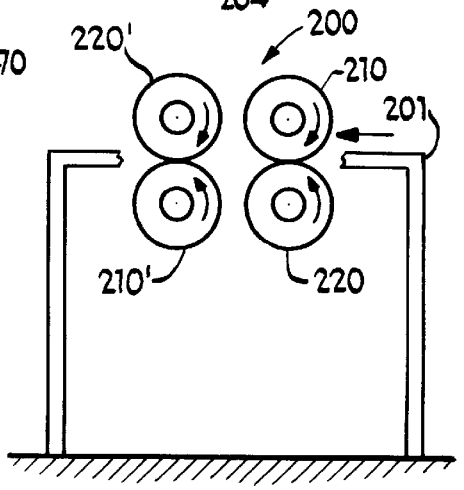
Fig 8

SUBSTANTIALLY RECTANGULAR-BOTTOMED CONTAINER, AND APPARATUS AND METHOD FOR MANUFACTURING SAME

BACKGROUND OF THE INVENTION

The present invention relates in general to containers, and, more particularly, to containers deployable from a substantially flat, collapsed configuration to a substantially rectangular-bottomed configuration.

Deployable containers having substantially rectangular bottoms when fully deployed are well known in the art. Examples of such prior art containers are Zuege et al, U.S. Pat. No. 5,474,383; Watkins et al., U.S. Pat. No. 5,044,777; Watkins et al., U.S. Pat. No. 4,450,180; Watkins et al., U.S. Pat. No. 4,691,374; and Danish Patent No. 815,442 to Honsfl. Each of these references discloses an erectable container having gusseted side panels, which, when deployed, include deployed bottoms having a relatively flat, rectangular-bottomed configuration.

In general, it is desirable that such a container deploy with as square a bottom as possible; i.e., with its bottom substantially perpendicular to the container's front panel, back panel, and gusseted side panels, upon deployment. This deployment may occur, for example, during filling of the container with food articles, or during expansion of food articles already stored within the container, such as may occur during microwave cooking.

Accordingly, it is an object of the present invention to provide a deployable container having a substantially rectangular bottom when fully deployed, wherein the construction of the container facilitates deployment from a substantially flat, collapsed configuration to a substantially rectangular-bottomed configuration.

It is another object of the present invention to provide an apparatus for manufacturing such a container.

It is yet another object of the present invention to provide a method for manufacturing such a container.

These and other objects, features, and modes of operation of the present invention will become apparent in light of the present specification, drawings and claims.

SUMMARY OF THE INVENTION

The present invention comprises a container apparatus deployable from a substantially flat, collapsed configuration to a substantially rectangular bottomed configuration. The container apparatus includes a front panel, a back panel, a first gusseted side panel, and a second gusseted side panel.

Each of the front, back and gusseted side panels has an interior surface, an exterior surface, a top edge proximate a top portion, and a bottom edge proximate a bottom portion. The top and bottom edges of the front, back and gusseted side panels collectively define a top and a bottom of the container apparatus, respectively.

The front and back panels each have a first side edge and a second side edge, with the first and second side edges being substantially parallel to each other. The front and back panels are positioned opposite each other and are operably connected at their respective first and second side edges to the first and second gusseted side panels, respectively, so as to form a substantially tubular configuration.

The respective bottom portions of the gusseted side panels and the front and back panels are attached to each other to collectively form a substantially closed bottom of the container apparatus. This substantially closed bottom is articulable into a substantially flat surface, substantially perpendicular to each of the gusseted side panels and the front and back panels, upon deployment of the container apparatus.

Moreover, each of the gusseted side panels and the front and back panels has a first transverse score line, forming a peripheral edge of the substantially rectangular bottom of the deployed container apparatus. The first transverse score line is scored in a first direction, extending substantially from the front panel towards the back panel of the container apparatus.

Each of the gusseted side panels and the front and back panels further has a second transverse score line which is substantially congruent with the first transverse score line. This second transverse score line is scored in a second direction, extending substantially from the back panel towards the front panel of the container apparatus.

This congruence of the first and second transverse score lines serves to facilitate the deployment of the container apparatus from its substantially flat, collapsed configuration to its substantially rectangular-bottomed configuration.

In a preferred embodiment, the container apparatus further includes sealing means proximate the bottom of the container apparatus for sealing each of the front, back and gusseted side panels to one another proximate to the bottom of the container apparatus. This sealing means operably connects the front, back and gusseted side panels to collectively seal the bottom of the container apparatus into a substantially pinch-ended bottom when the container apparatus is in its substantially flat, collapsed configuration prior to the deployment of the container apparatus.

The present invention also comprises an apparatus for manufacturing the previously described container. First scoring means are provided for scoring each of the gusseted side panels and the front and back panels with the first transverse score line forming the peripheral edge of the substantially rectangular bottom upon the deployment of the container. Second scoring means are provided for scoring each of the gusseted side panels and the front and back panels with the second traverse score line substantially congruent with the first transverse score line.

In a preferred embodiment, the first scoring means comprises a first rotating member having at least one male scoring member disposed upon and fixed for rotation with an outer surface of the first rotating member, and a second rotating member having at least one female scoring groove disposed upon and fixed for rotation with an outer surface of the second rotating member. The outer surfaces of the first and second rotating members are operably positioned proximate each other, and counter rotate relative to each other, such that each of the at least one scoring member of the first rotating member substantially aligns once per rotation with an associated female scoring groove of the second rotating member. This substantial alignment of a male scoring member with an associated female scoring groove serves to score the container propelled between the first and second rotating members, forming the first transverse score line.

Also, in a preferred embodiment, the second scoring means includes a third rotating member having at least one male scoring member disposed upon and fixed for rotation with an outer surface of the third rotating member, and a fourth rotating member having at least one female scoring groove disposed upon and fixed for rotation with an outer surface of the fourth rotating member. The outer surfaces of the third and fourth rotating members are operably positioned proximate each other and counter rotate relative to each other, such that each of the at least one male scoring member of the third rotating member substantially aligns once per rotation within an associated female scoring groove of the fourth rotating member. This substantial alignment serves to score a container propelled between the first and second rotating members. This, in turn, forms the second transverse score line congruent to the first transverse score line.

Moreover, in a preferred embodiment, the male scoring member comprises a scoring blade releasably attached to the first rotating member. The second rotating member preferably includes a recessed region disposed upon an outer surface of the second rotating member. The female scoring groove is disposed upon a female scoring pad, which is releasably attached to the recessed region of the outer surface of the second rotating member.

The present invention also comprises a method for manufacturing the previously-described container. The method includes the steps of: 1) scoring each of the gusseted side panels and the front and back panels with the first transverse score line forming the peripheral edge of the substantially rectangular bottom upon deployment of the container; and 2) scoring each of the gusseted side panels and the front and back panels with the second transverse score line substantially congruent with the first transverse score line, in a second, opposing direction relative to the first score line.

BRIEF DESCRIPTION OF THE DRAWINGS

FIG. 1 of the drawings is a perspective view of the container apparatus in its deployed configuration;

FIG. 2 of the drawings is a bottom plan view of the deployed container apparatus of FIG. 1;

FIG. 3 of the drawings is an elevated front view of the container apparatus of FIG. 1 in its collapsed configuration;

FIG. 4 of the drawings is an elevated, partial back view of the collapsed container apparatus of FIG. 3;

FIG. 5 of the drawings is an elevated, partial side view of the collapsed container apparatus of FIGS. 3 and 4;

FIG. 6 of the drawings is an elevated back view of the unerected blank of the interior of the container apparatus of FIGS. 1–5;

FIG. 7 of the drawings is an elevated, schematic side view of the container manufacturing apparatus;

FIG. 8 of the drawings is an enlarged elevated side view of the scoring unit of the container manufacturing apparatus of FIG. 7;

FIG. 9 of the drawings is a top plan view of the scoring unit of FIG. 8;

FIG. 10 of the drawings is an elevated side view of the male scoring drum of the scoring unit of FIGS. 8–9;

FIG. 11 of the drawings is a perspective view of the male scoring drum of FIG. 10;

FIG. 12 of the drawings is an elevated view of the female scoring drum of the scoring unit of FIGS. 8–9;

FIG. 13 of the drawings is a perspective view of the female scoring drum of FIG. 12; and FIG. 14 of the drawings is an elevated, side sectional schematic view of a portion of the scoring unit of FIGS. 8–9 showing, in particular, the scoring of the continuous tube.

DETAILED DESCRIPTION OF THE DRAWINGS

While this invention is susceptible of embodiment in many different forms, there is shown in the drawings and will herein be described in detail, one specific embodiment, with the understanding that the present disclosure is to be considered as an exemplification of the principles of the present invention, and is not intended to limit the invention to the embodiment illustrated.

The present container apparatus 10 is shown in FIGS. 1–5 as including front panel 20, back panel 30, gusseted side panel 40, gusseted side panel 50, and bottom panel 60. Front panel 20 includes side edges 21 and 22. Back panel 30 includes side edges 31 and 32. Gusseted side panel 40 includes side edges 41 and 42, and center gusset fold 43. Gusseted side panel 50 includes side edges 51 and 52, and center gusset fold 53. Front panel 20 further includes a thumb notch 23, proximate a top end of the container.

As shown in FIG. 1, front panel 20 and back panel 30 are positioned opposite each other, and connected at their respective side edges to the gusseted side panels, so as to form a substantially tubular configuration. In particular, side edge 21 of front panel 20 is connected to side edge 41 of gusseted side panel 40. Side edge 22 of front panel 20 is connected to side edge 52 of gusseted side panel 50. Side edge 31 of back panel 30 is connected to side edge 51 of gusseted side panel 50. Side edge 32 of back panel 30 is connected to side edge 42 of gusseted side panel 40.

Bottom portions of the gusseted side panels and the front and back panels are attached to each other to collectively form a "pinch-ended" bottom to the container. In particular, a transverse bottom seal seals a bottom portion of the interior of front panel 20 to a corresponding bottom portion of an interior surface of back panel 30. Moreover, this transverse bottom seal further seals a bottom, interior portion of gusseted side panels 40 and 50, proximate side edges 41 and 52, respectively, to abutting portions of the interior surface of front panel 20. Further, this transverse seal also seals bottom portions of the interior surfaces of gusseted side panels 40 and 50, proximate side edges 42 and 51, respectively, to abutting bottom portions of the interior surface of back panel 30. As shown in FIGS. 2, 4 and 5, this seal creates a bottom flap 61, having flap edge 62. Edge 62 forms the lowest edge of bag 10, prior to formation of bottom 60; into which flap 61 is integrated. Bottom flap 61 is folded at fold line 63, for integration onto an abutting portion of bottom 60 of container 10.

As shown in FIGS. 2 and 9, container 10 includes four diagonal fold lines for forming the substantially rectangular-bottomed configuration of the container, upon its deployment from the substantially flat, collapsed configuration. As shown in FIG. 2, four regions of adhesive or cohesive 68 are employed to attach portions of the gusseted side panels adjacent the diagonal fold lines to corresponding, abutting portions of the front and back panels of the container.

As shown in FIGS. 1, 2, 4 and 5, two congruent, transverse score lines 70 are employed to facilitate the deployment of the container from its substantially flat, collapsed configuration to its substantially rectangular-bottomed configuration. In particular, a first transverse score line, forming a peripheral edge of the substantially rectangular bottom, is scored in a first direction, extending from front panel 20 towards back panel 30. Moreover, a second score line, congruent with the first score line, is scored in a second, opposing direction, extending from back panel 30 towards front panel 20. In this manner, the paper fibers of container 10 are essentially broken in two opposing directions proximate score line 70. This, in turn, provides enhanced flexibility of the material of container 10 proximate score line 70, facilitating the deployment of the container into its substantially rectangular-bottomed configuration.

The article blank 10' for fabricating container 10 is shown in FIG. 6. Article blank 10' includes an elongated flap member 80 operably attached to gusseted side panel 40. The substantially tubular configuration of container 10 is achieved by rotating flap member 80 towards side edge 32 of back panel 30, and then attaching an exterior surface of tab member 80 to a corresponding longitudinal portion of the interior surface of back panel 30, adjacent side edge 32.

Apparatus 100 for manufacturing container 10 is shown in FIG. 7 as comprising supply 101 of paper 102, supply 103 of film 104, laminating unit 105, tube former 106, scoring unit 200, tube severing means 107, and bottom former 108. Supply 101 provides a continuous web (i.e., a substantial length) of a paper material 102, forming the outer ply of two-ply container 10. Paper material 102 may comprise, for example, 41 lb. paper material. Supply 103 provides a continuous web of film 104, providing an inner ply of two-ply container 10. Film 104 may comprise, for example, a 70 gauge metallized polypropylene material.

Outer ply 102 and inner ply 104 are laminated together by conventional laminating unit 105. The laminated plies are next formed into a continuous tube, by conventional tube former 106. Scoring unit 200 then scores the first and second congruent transverse score lines upon sections of the continuous tube within what will later be severed and folded into individual, fully formed bags. Following scoring by scoring unit 200, a conventional tube severing unit 108 severs predetermined lengths of material from the leading edge of the laminated, continuous tube. Next, at station 108, formation of individual containers 10 is completed, using conventional bottom formers. After the laminate has been formed into a continuous tube, the tube travels along a direction L (see FIG. 7), which is also substantially parallel to the longitudinal axis of the continuous tube at that point.

If desired, conventional prior art bag formation equipment may be retrofitted to include scoring unit 200. Such a conventional bag formation machine may comprise, for example, a model 279 bag forming machine supplied by the C. & A. Holweg Company of Strasbourg, France. Moreover, while apparatus 100 is shown for fabricating a multi-ply container, it is also contemplated single-ply containers be fabricated, such as by the elimination of film supply 103 and laminating unit 105 from apparatus 100.

As shown in FIGS. 8 and 9, scoring unit 200 includes four rotating scoring members, including male scoring drums 210 and 210', and female scoring drums 220 and 220'. The construction of male scoring drums 210 and 210' are substantially identical to each other, as are the construction of female scoring drums 220 and 220'.

An outer surface of male scoring drum 210 counter-rotates adjacent a corresponding outer surface of female scoring drum 220, while an outer surface of female scoring drum 220' rotates adjacent a counter-rotating surface of male scoring drum 210'. As shown in FIG. 9, each scoring drum is mounted to an associated shaft 202, rotating in cooperation with associated bearings 203 mounted within a support frame 201. Moreover, each shaft 202 is driven by an associated drive mechanism 204, which may include, for example, gears or belt-driven pulleys.

As shown in FIGS. 10 and 11, male scoring drum 210 includes a central bore 211, for mounting of male scoring member 210 concentric to and fixed for rotation with an associated drive shaft. A plurality of threaded apertures 212, communicating with both central bore 211 and the outer surface of male scoring drum 210, permit set screws to be used to releasably attach male scoring drum 210 to an associated shaft at any desired rotational orientation, relative to the rotational position of the shaft.

Male scoring drum 210 further includes transverse slot 214, for acceptance of scoring blade 213 therewithin. Flange member 215 of male scoring drum 210 includes a plurality of threaded apertures 216, permitting set screws 217 to releasably retain scoring blade 213 within slot 214. Moreover, scoring depth may be adjusted by varying the height at which scoring blade 213 extends beyond the outer surface of male scoring drum 210, prior to the tightening of set screws 217.

Female scoring drum 220 is shown in FIGS. 12 and 13 as including central bore 221 for mounting of female scoring drum 220 concentric to and fixed for rotation with an associated shaft. A plurality of threaded apertures 222, communicating with both central bore 221 and an outer surface of female scoring drum 220, permit female scoring drum 220 to be releasably attached at any desired rotation orientation, relative to the rotational position of the associated shaft.

Female scoring drum 220 includes two longitudinal recessed regions 223, 224, oriented 180° opposite each other about the circumference of female scoring drum 220. A suitable adhesive is employed to firmly yet releasably attach scoring pad 225 to recess region 223, and to attach scoring pad 225' to recess region 224. Each scoring pad 225, 225' is preferably constructed of a polyurethane material, such as a 90 durometer polyurethane material. Moreover, each scoring pad includes a plurality of longitudinal scoring grooves 226, 226', 227 and 227'.

As shown in FIG. 14, male scoring drum 210 is mounted to its associated shaft 202, and female scoring drum 220 is mounted to its associated shaft, such that, as continuous tube 10" passes between the counter-rotating scoring drums, scoring blade 213 aligns with a corresponding female scoring groove, such as scoring groove 227 for each rotation of the scoring drums. As female scoring groove 227 is worn from repeated use, the rotational orientation of female scoring drum 220 may be adjusted such that scoring blade 213 instead aligns with another female scoring groove of either scoring pad 225 or scoring pad 225'.

Moreover, the alignment of scoring blade 213 with an associated female scoring groove is at a repeating position along continuous tube 10", relative to the subsequent severing of the tube, which will correspond to the bottom peripheral positioning of score line 70 upon a fully formed container 10. The rotational orientations of male scoring drum 210' and female scoring 220' (FIG. 8) are substantially identical to that shown with respect to male scoring drum 210 and female scoring drum 220 within FIG. 14; with the exception that the positions of male scoring drum 210 and female scoring drum 220 are reversed, with female scoring drum 220' rotating adjacent a top portion of continuous tube 10", and male scoring drum 210' counter-rotating adjacent a bottom portion of continuous web 10".

Moreover, in addition to being aligned with each other such that a male scoring blade substantially aligns with a corresponding female scoring groove, male scoring drum 210' and female scoring drum 220' are further aligned with respect to the rotational positions of male scoring drum 210 and female scoring drum 220 such that scoring drums 210' and 220' impress a second transverse score line upon continuous tube 10" at substantially the same, congruent position with the first score line impressed upon the continuous tube by scoring drums 210 and 220. In this manner, continuous tube 10", and, in turn, subsequently formed individual containers 10, are scored in two opposing directions proximate a bottom periphery of the deployed, rectangular-bottomed container.

The foregoing description and drawings merely explain and illustrate the invention and the invention is not limited thereto, except insofar as the appended claims are so limited, as those skilled in the art who have the present disclosure before them will be able to make modifications and variations therein without departing from the scope of the invention.

What is claimed is:

1. A method for manufacturing a container deployable from a substantially flat, collapsed configuration to a substantially rectangular-bottomed configuration, said method comprising the steps of:

supplying a web of paper material;

forming the web into a continuous tube, wherein the tube is provided with a front panel portion, an opposing back panel portion, and two gussetted side panel portions between and interconnecting the front and back panel portions, the continuous tube having a longitudinal axis extending substantially parallel to a direction of travel of the continuous tube;

scoring each of said gusseted side panel portions and said front and back panel portions with a first transverse score line, extending across the formed tube in a direction perpendicular to the longitudinal axis of the continuous tube for forming a peripheral edge of said substantially rectangular bottom upon said deployment of a formed container, said first transverse score line being formed by pressing a scoring implement in a first direction into said front panel portion towards said back panel portion; and scoring each of said gusseted side panel portions and said front and back panel portions with a second transverse score line, extending across the formed tube in a direction perpendicular to the longitudinal axis of the continuous tube substantially juxtaposed over said first transverse score line, at substantially the same longitudinal position along the formed tube as said first transverse score, said second transverse score line being formed by pressing a scoring implement in a second direction into said back panel portion towards said front panel portion, the second transverse score line being formed at a location along the bag forming path downstream from the location at which the first transverse score line is formed, said congruent juxtaposed first and second transverse score lines serving to facilitate deployment of a formed said container from a substantially flat, collapsed configuration to a substantially rectangular-bottomed configuration;

severing the scored, continuous tube into discrete tube portions;

forming a gussetted pinch-bottom in each successive discrete tube portion to preliminarily form formed container blanks prior to articulation of the substantially rectangular bottom;

folding and sealing each successive formed container blank into a container.

2. The method according to claim 1, further comprising the steps of:

supplying a web of film;

laminating the web of paper material to the web of film, prior to forming the continuous tube.

* * * * *